US007404562B2

(12) United States Patent
Chen et al.

(10) Patent No.: US 7,404,562 B2
(45) Date of Patent: Jul. 29, 2008

(54) QUICK DETACHABLE BASKETBALL MACHINE

(75) Inventors: Chan-Yih Chen, Taichung (TW); Cheng-Chun Chiang, Taipei Hsien (TW)

(73) Assignee: Saint-Fun International Ltd., Shu-Lin, Taipei Hsien (TW)

( * ) Notice: Subject to any disclaimer, the term of this patent is extended or adjusted under 35 U.S.C. 154(b) by 129 days.

(21) Appl. No.: 11/535,068

(22) Filed: Sep. 26, 2006

(65) Prior Publication Data

US 2008/0042358 A1 Feb. 21, 2008

(30) Foreign Application Priority Data

Aug. 16, 2006 (TW) ..... 95214449 U

(51) Int. Cl.
*A63F 7/20* (2006.01)

(52) U.S. Cl. ..... 273/317.3

(58) Field of Classification Search ..... 273/317, 273/317.3, 440, 445; 473/479, 481, 485; 312/107, 108, 198, 200, 257.1, 258, 265.5, 312/223.1

See application file for complete search history.

(56) References Cited

U.S. PATENT DOCUMENTS

| | | | | |
|---|---|---|---|---|
| 2,433,224 | A * | 12/1947 | Koci et al. | 273/317.3 |
| 3,050,304 | A * | 8/1962 | Hulsebus | 473/447 |
| 5,443,259 | A * | 8/1995 | Segan et al. | 273/352 |
| 6,536,770 | B1 * | 3/2003 | Yang | 273/317.3 |
| 7,063,326 | B1 * | 6/2006 | Smart | 273/447 |
| 2008/0042358 | A1 * | 2/2008 | Chen et al. | 273/317.3 |

* cited by examiner

*Primary Examiner*—Raleigh W. Chiu
(74) *Attorney, Agent, or Firm*—Pai Patent and Trademark Law Firm; Chao-Chang David Pai

(57) ABSTRACT

A quick detachable basketball machine comprising a front cabinet unit and a rear cabinet unit is disclosed. The front cabinet unit has an electronic coin slot box, two lower side panels, two upper side panels detachably connected to the lower side panels at the top, an oblique baffle obliquely detachably coupled between the upper side panels, an outer guide board detachably supported between the lower side panels, and two stop blocks mounted on the outer guide board. The rear cabinet unit has a bottom box, a vertical back rack hinged to the rear side of the top wall of the bottom box and holding a rim hoop ring, two side panels respectively hinged to two opposite lateral sides of the top wall of the bottom box and connectable to the bottom side of the vertical back rack, and a top plate bridging the side panels.

15 Claims, 15 Drawing Sheets

QUICK DETACHABLE BASKETBALL MACHINE

BACKGROUND OF THE INVENTION (a) Field of the Invention

The present invention relates to basketball machines and more particularly to a quick detachable basketball machine that is easily and quickly detachable.

(b) Description of the Prior Art

Regular basketball machines can be started for playing basketball shooting game after inserting a qualified coin. Conventional basketball machines are commonly huge, requiring a big place. These conventional basketball machines require much warehouse space and use a big amount of packing materials during transportation. In order to save transportation and warehouse cost, the parts of basketball machines must be detached and separately packed. However, it is complicated to detach conventional basketball machines. Mounting and dismounting conventional basketball machines take much time and labor.

SUMMARY OF THE INVENTION

The present invention has been accomplished under the circumstances in view. It is one object of the present invention to provide a quick detachable basketball machine to reduce the dimensions for storage and delivery, thereby saving much inventory and transportation cost.

To achieve this and other objects of the present invention, the basketball machine comprises a front cabinet unit and a rear cabinet unit. The front cabinet unit comprises an electronic coin slot box, two lower side panels bilaterally detachably connected to the back wall of the electronic coin slot box, two upper side panels respectively detachably connected to a respective top side of the lower side panels, an oblique baffle obliquely detachably coupled between the two upper side panels, an outer guide board detachably supported between the lower side panels, and two stop blocks bilaterally mounted on the outer guide board. The rear cabinet unit comprises a bottom box, a vertical back rack holding a rim hoop ring and coupled to the rear side of the top wall of the bottom box and movable relative to the bottom box between a vertical position and a horizontal position where the vertical back rack is closely attached to the top wall of the bottom box, two side panels respectively hinged to two opposite lateral sides of the top wall of the bottom box and turnable relative to the bottom box between an operative position and a non-operative position where the two side panels are respectively closely attached to two opposite lateral sides of the bottom box.

DETAILED DESCRIPTION OF THE PREFERRED EMBODIMENTS

Figure 1:
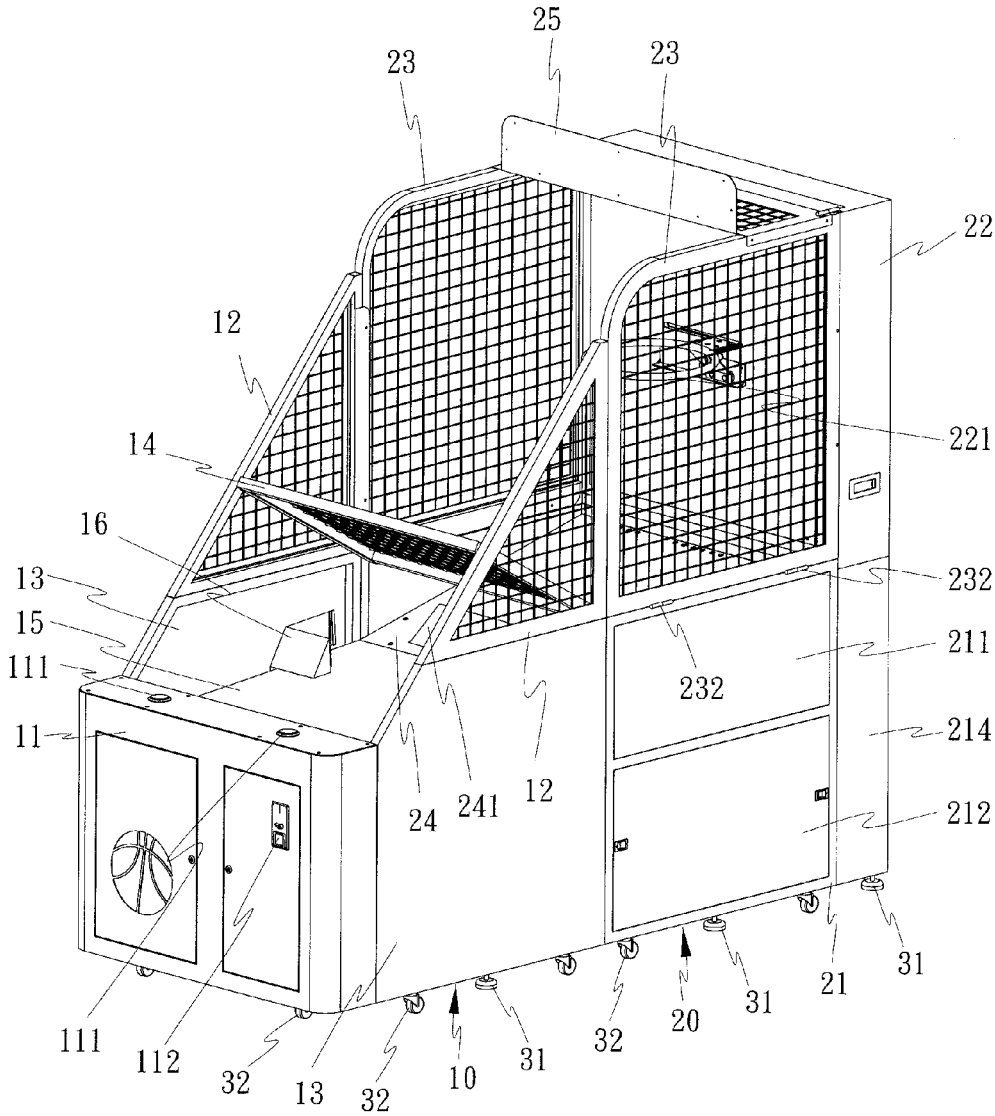
FIG. 1 is a perspective view of a basketball machine according to the present invention.

In FIG. 1, a quick detachable basketball machine in accordance with the present invention is shown comprised of a front cabinet unit 10 and a rear cabinet unit 20. The front cabinet unit 10 and the rear cabinet unit 20 abut each other. The front cabinet unit 10 comprises an electronic coin slot box 11, two upper side panels 12, two lower side panels 13, an oblique baffle 14, an outer guide board 15, and two stop blocks 16. The rear cabinet unit 20 comprises a bottom box 21, a meshed vertical back rack 22, and two side panels 23 at the top of the bottom box 21.

Figure 5:
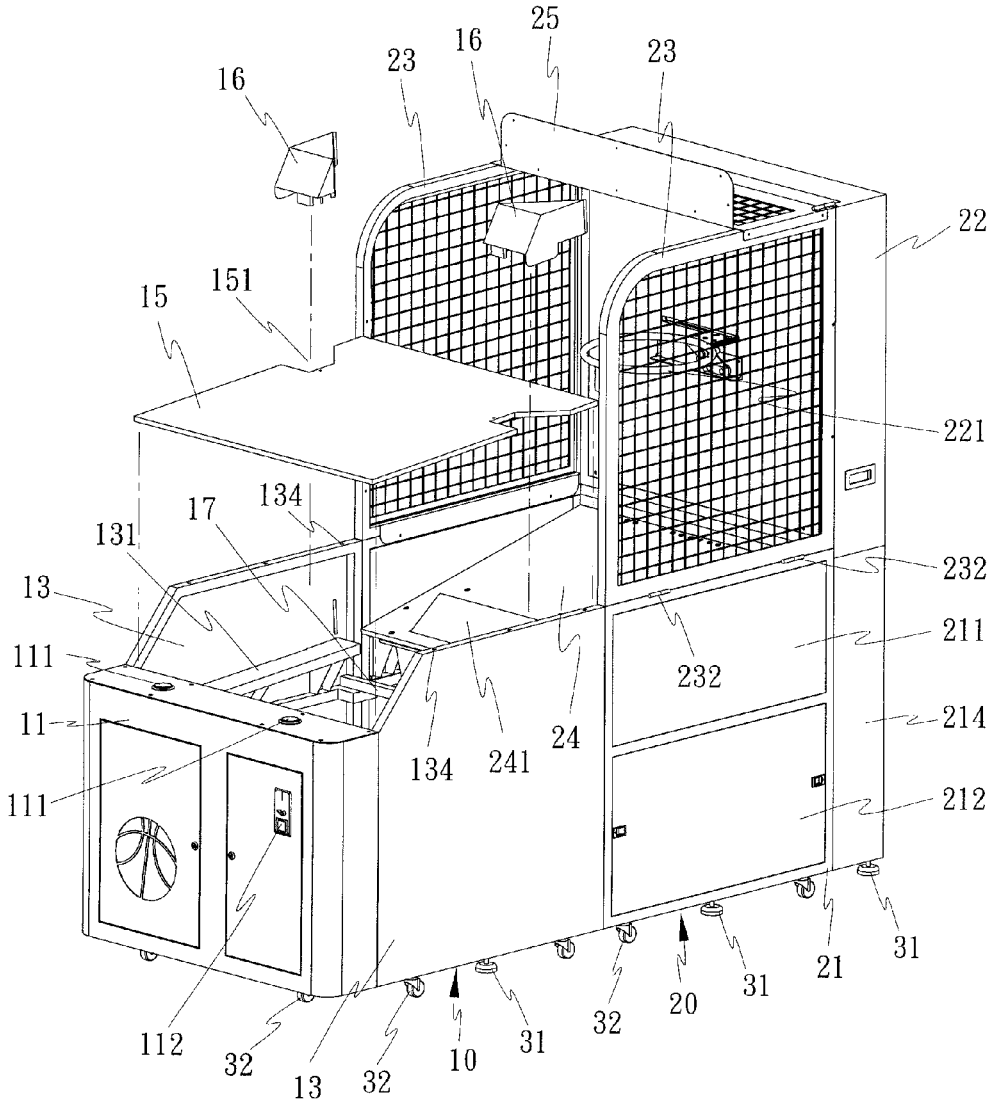
FIG. 5 corresponds to FIG. 4, showing the outer guide board and the stop blocks detached from the front cabinet unit.
Figure 6:
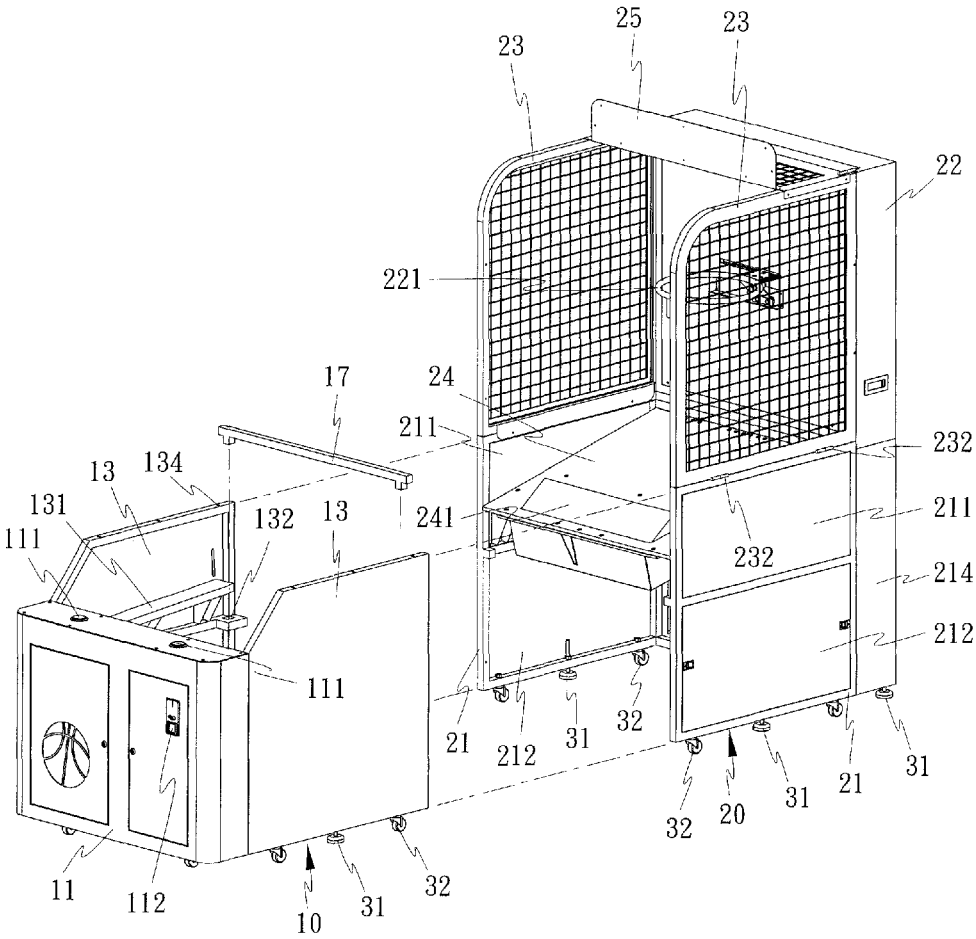
FIG. 6 corresponds to FIG. 5, showing the crosspiece detached from the front cabinet unit and the front cabinet unit detached from the rear cabinet unit.

The two lower side panels 13 are bilaterally adjustably connected to the back side of the electronic coin slot box 11 so that the pitch between the two lower side panels 13 is adjustable. The two upper side panels 12 are respectively detachably connected to the lower side panels 13 at the top. The oblique baffle 14 is detachably connected between the two upper side panels 12 and sloping downwardly backwards toward the rear cabinet unit 20. The lower side panels 13 each have a rail 131 disposed at an inner side (see FIG. 5) and sloping obliquely forwards for supporting the outer guide board 15. The outer guide board 15 has a side notch 151 at each of two opposite lateral sides thereof for receiving the stop blocks 16 (see FIG. 5). The lower side panels 13 each further have a mounting hole 132 for positioning a crosspiece 17 (see FIG. 6) that provides a transverse support to the front cabinet unit 10.

The electronic coin slot box 11 is of the known art, having buttons 111, a coin slot 112, and an electronic substrate (not shown) on the inside. The basketball shooting game can be started when a coin is inserted into the coin slot 112.

Figure 7:
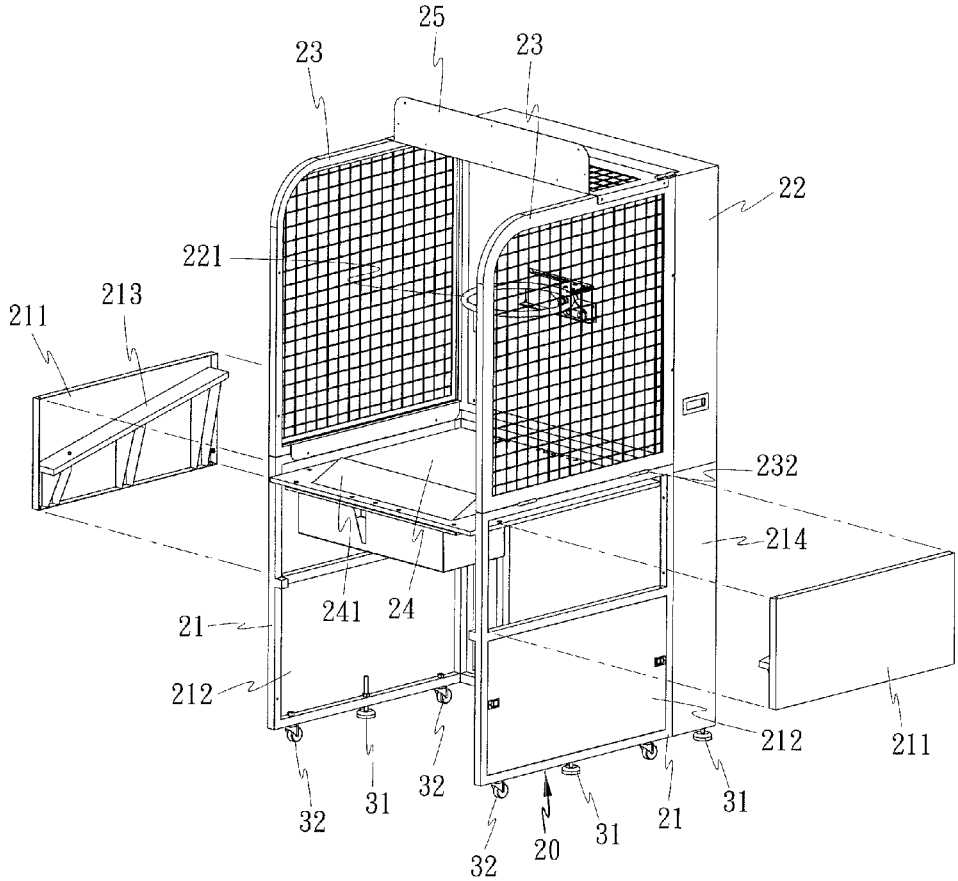
FIG. 7 is an exploded view of the rear cabinet unit of the basketball machine according to the present invention, showing the two upper sideboards detached from the bottom box.
Figure 8:
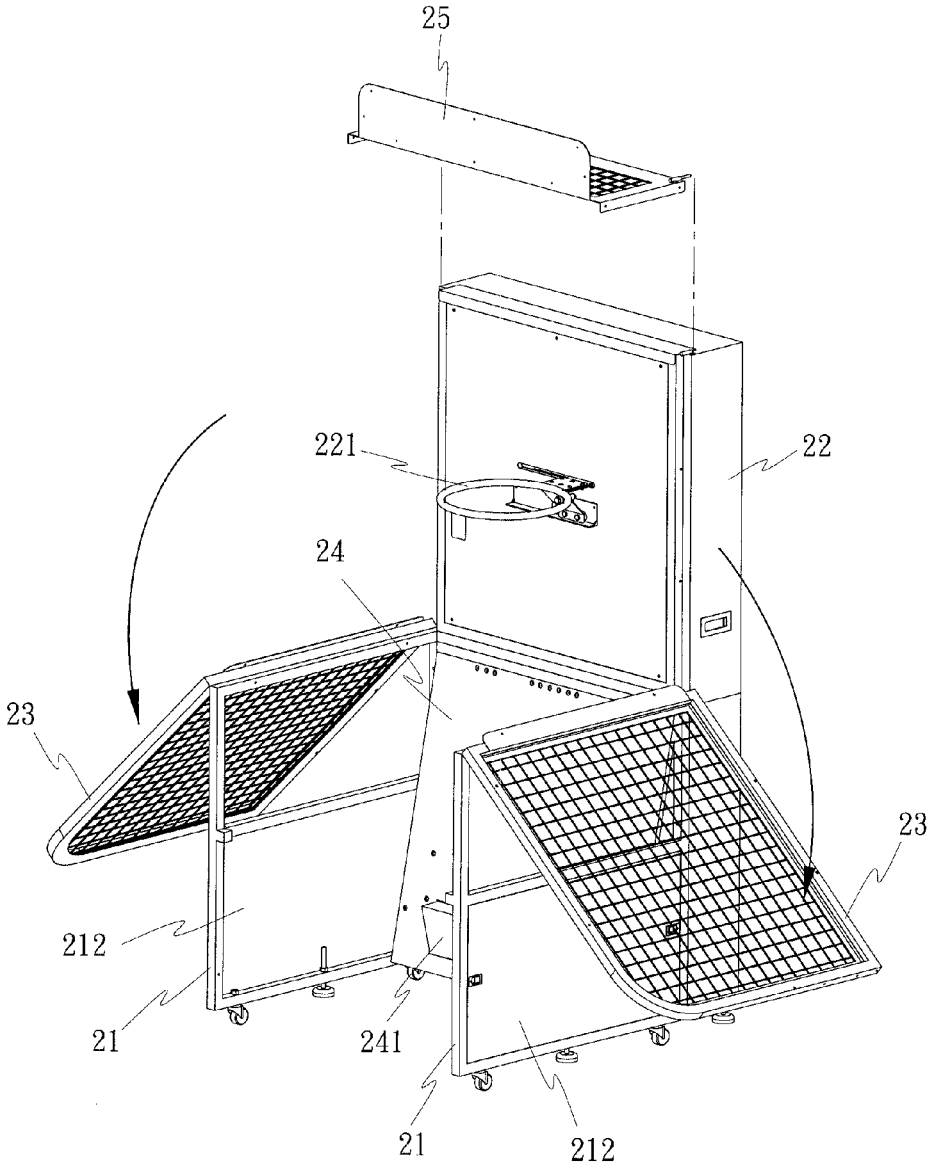
FIG. 8 illustrates the top plate detached from the side panels of the rear cabinet unit and the side panels turned outwardly downwards toward the two opposite lateral sides of the bottom box.
Figure 9:
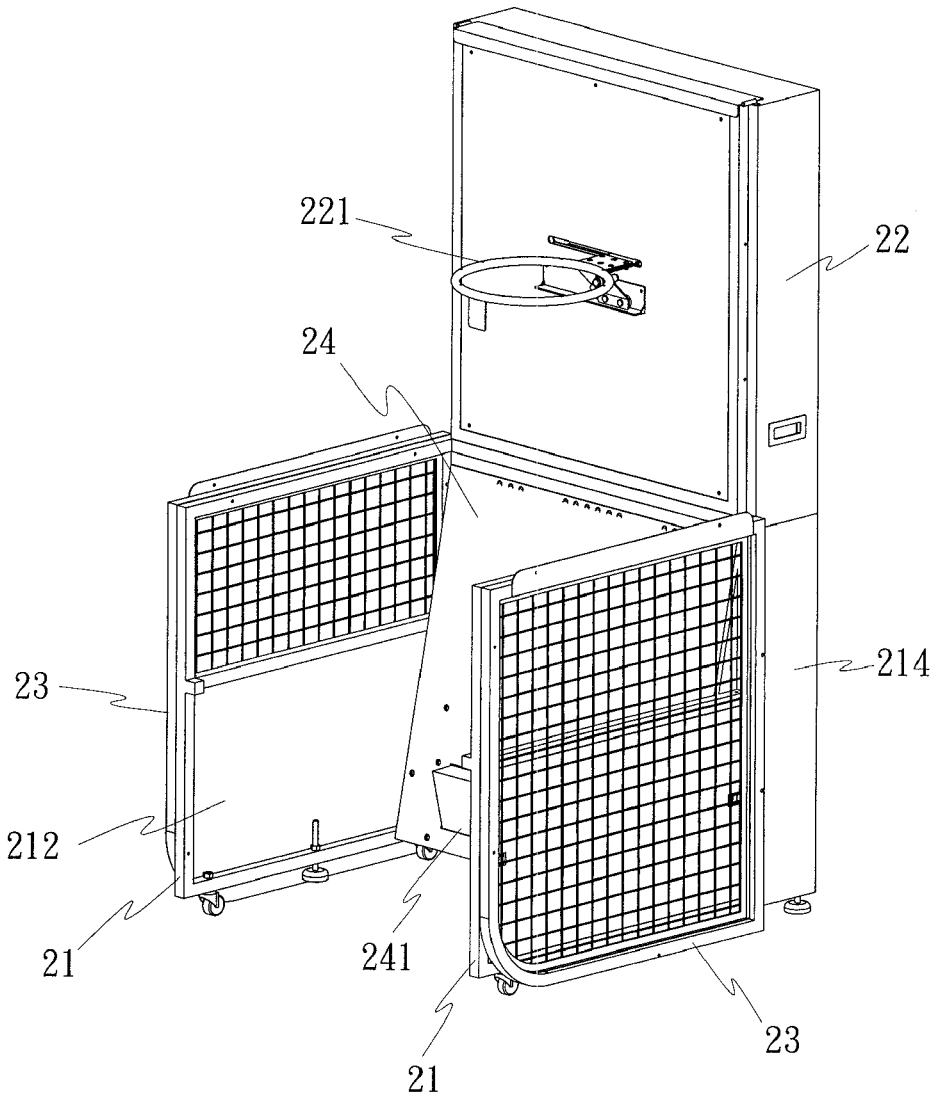
FIG. 9 corresponds to FIG. 8, showing the side panels closely attached to the two opposite lateral sides of the bottom box.
Figure 10:
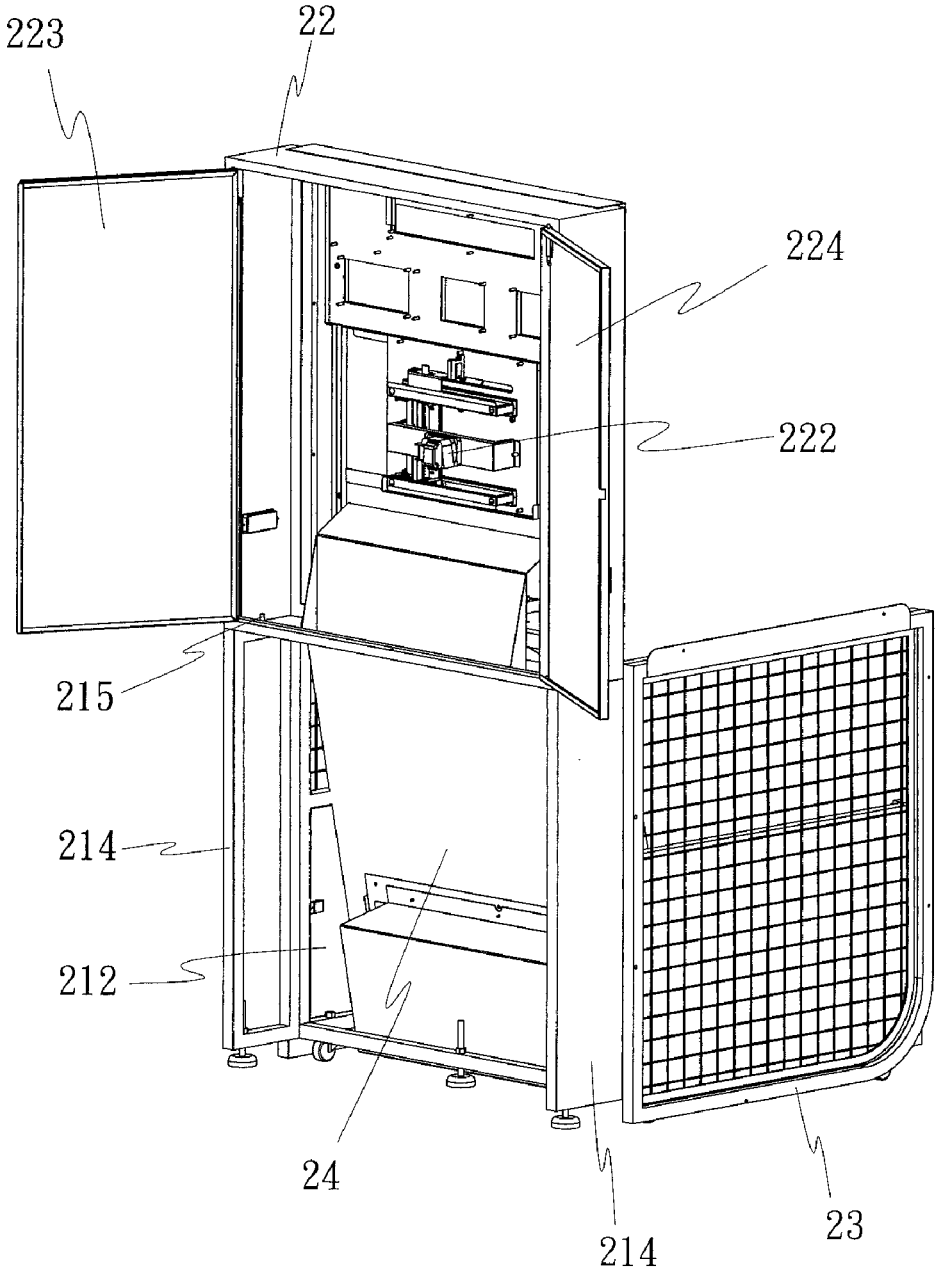
FIG. 10 is an oblique rear side view of FIG. 9, showing the door panels of the vertical back rack opened.
Figure 11:
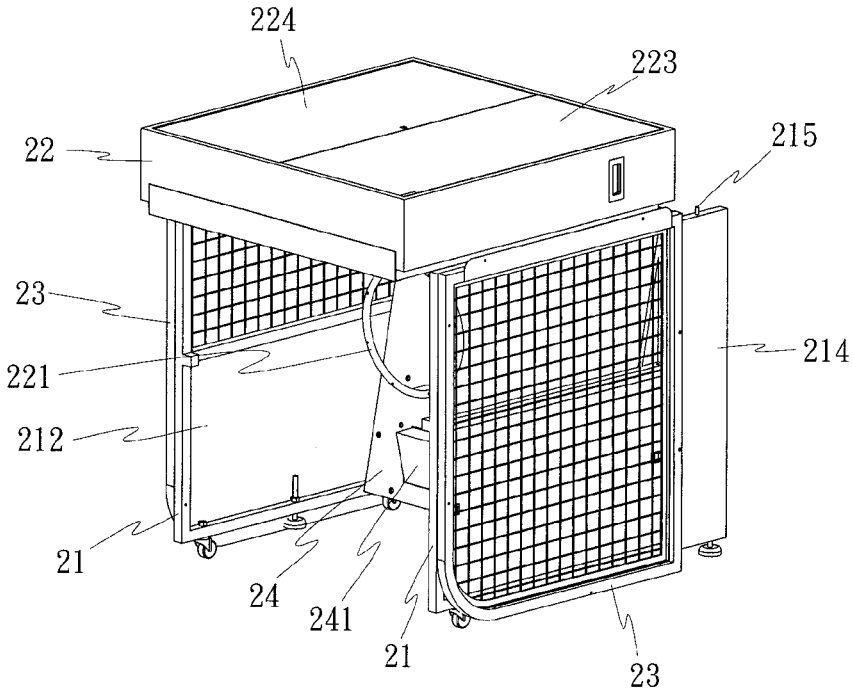
FIG. 11 corresponds to FIG. 9, showing the vertical back rack closely attached to the top side of the bottom box.
Figure 12:
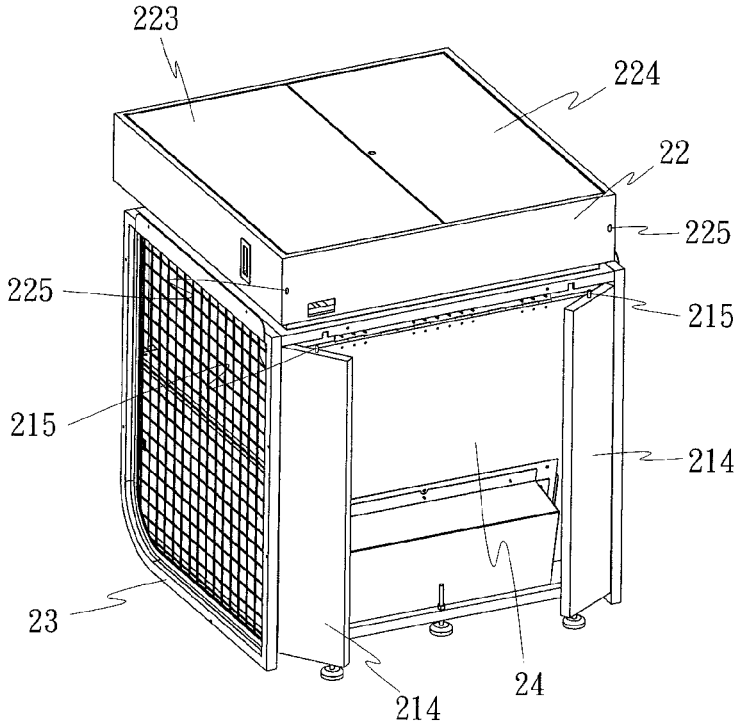
FIG. 12 corresponds to FIG. 11, showing the two side jambs respectively turned inwards toward the back side of the bottom box.
Figure 13:
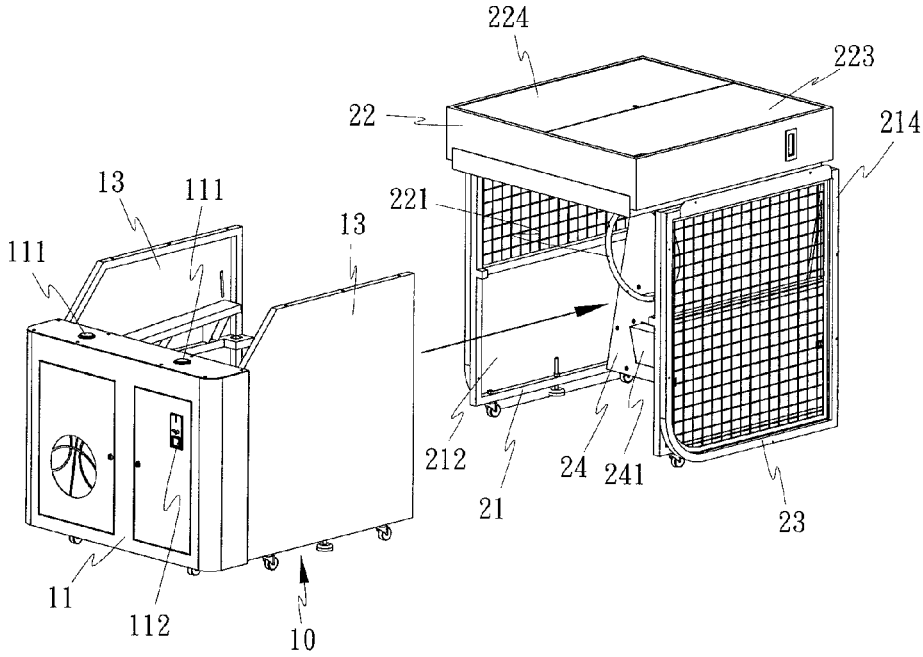
FIG. 13 illustrates the pitch between the two lower side panels of the front cabinet unit adjusted and the rear cabinet unit collapsed.

As indicated above, the rear cabinet unit 20 comprises a bottom box 21, a vertical back rack 22 transversely provided at the top of the bottom box 21, and two side panels 23 bilaterally provided at the top of the bottom box 21 and respectively perpendicularly connected to the vertical back rack 22. The bottom box 21 has two upper sideboards 211 respectively disposed at two opposite lateral sides, and two lower sideboards 212 respectively disposed below the two upper sideboards 211. The two upper sideboards 211 each have a rail 213 obliquely disposed at an inner side (see FIG. 7) for supporting an inner guide board 24. The inner guide board 24 is hinged to the bottom box 21. After removal of the upper sideboards 211 from the bottom box 21, the inner guide board 24 can be turned downwards to a suitable angle. Further, a top plate 25 is supported on the two side panels 23. A rim hoop ring 221 is provided at the front side of the vertical back rack 22. Motor-driven lifting means may be installed in the vertical back rack 22 to hold the rim hoop ring 221, and controlled to move the rim hoop ring 221 to the desired elevation. The two side panels 23 are respectively coupled to the bottom box 21 by hinges 232. After removal of the top plate 25, the two side panels 23 can be turned downwards and closely attached to the two opposite lateral sides of the bottom box 21. The vertical back rack 22 is also hinged to the back side of the bottom box 21. Further, the vertical back rack 22 is in the form of a box accommodating a power drive 222 and covered with two swinging door panels 223 and 224 (see FIG. 10). The bottom box 21 further has two side jambs 214 respectively hinged to the rear side thereof (see FIG. 11) for supporting the vertical back rack 22 (see FIG. 1). When not in use, the two side jambs 214 are respectively turned inwards and closely attached to the rear side of the bottom box 21 (see FIGS. 12 and 13). When detaching the rear cabinet unit 20, remove the top plate 25, then turn the two side panels 23 outwardly downwards to allow the two side panels 23 to be closely attached to the two opposite lateral sides of the bottom box 21, and then remove the upper sideboards 211 (see FIGS. 7~9) to allow the inner guide board 24 to be turned downwards, and then turn the vertical back rack 22 forwardly downwards for enabling the vertical back rack 22 to be closely attached to the top side of the bottom box 21, and therefore the rear cabinet unit 20 is collapsed (see FIGS. 11 and 12).

As stated above, the two lower side panels 13 are bilaterally adjustably connected to the back side of the electronic coin slot box 11 so that the pitch between the two lower side panels 13 is adjustable. When the positions of the two lower side panels 13 are adjusted to reduce the pitch between the two lower side panels 13 (see FIG. 13), the two lower side panels 13 can be inserted into the collapsed rear cabinet unit 20, keeping the electronic coin slot box 11 closely attached to the front side of the collapsed rear cabinet unit 20 (see FIG. 14). Thus, the collapsed basketball machine requires less storage space, thereby saving much delivery and invention cost.

Figure 15:
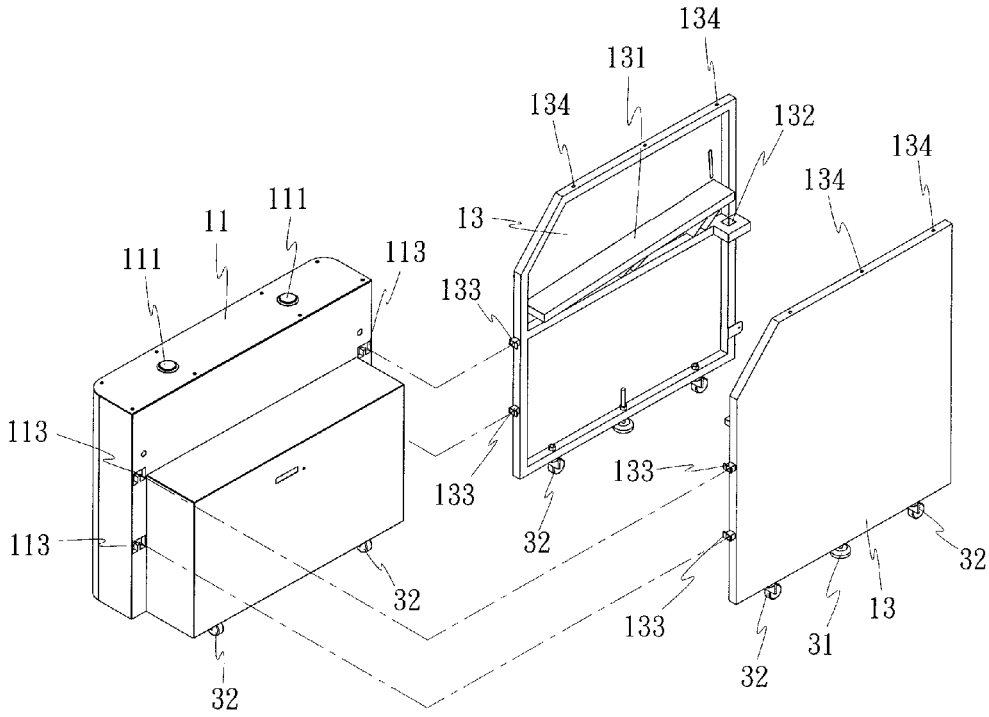
FIG. 15 is an exploded view of a part of the present invention, showing the lower side panels detached from the electronic coin slot box.
Figure 16:
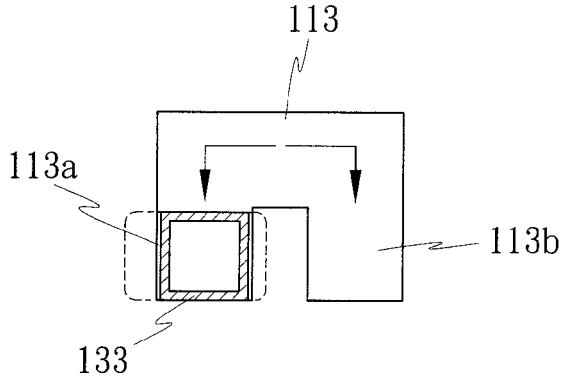
FIG. 16 is a schematic drawing showing the structure of the coupling holes of the female coupling portion of the electronic coin slot box according to the present invention.
Figure 17:
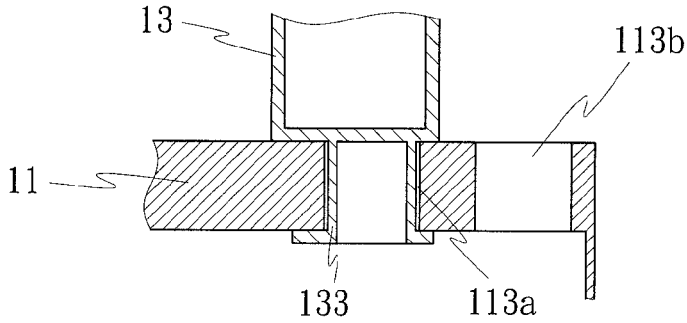
FIG. 17 is a schematic drawing showing one connection arrangement between one female coupling portion of the electronic coin slot box and the associating male coupling portion of the associating lower side panel.
Figure 18:
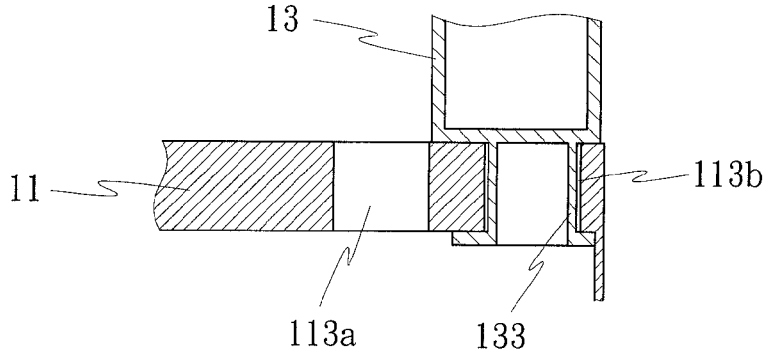
FIG. 18 is a schematic drawing showing another connection arrangement between one female coupling portion of the electronic coin slot box and the associating male coupling portion of the associating lower side panel.

Referring to FIG. 15, the electronic coin slot box 11 has a plurality of female coupling portions 113 bilaterally symmetrically formed on the back wall at different elevations. The lower side panels 13 each have a plurality of male coupling portions 133 protruded from the front side at different elevations (see FIG. 15). Referring to FIGS. 16~18, each female coupling portion 113 comprises two coupling holes 113*a* and 113*b*. The male coupling portions 133 of the lower side panels 13 are selectively coupled to the first coupling holes 113*a* of the female coupling portion 113 or the second coupling holes 113*b* of the female coupling portion 113. When the male coupling portions 133 of the lower side panels 13 are selectively coupled to the first coupling holes 113*a* of the female coupling portion 113, the pitch between the two lower side panels 13 is relatively greater. On the contrary, when the male coupling portions 133 of the lower side panels 13 arc selectively coupled to the second coupling holes 113*b* of the female coupling portion 113, the pitch between the two lower side panels 13 is relatively smaller. This coupling design is simply one example of the present invention for adjusting the pitch between the two lower side panels 13. Other measures that allow adjustment of the pitch between the two lower side panels 13 can be used.

Figure 3:
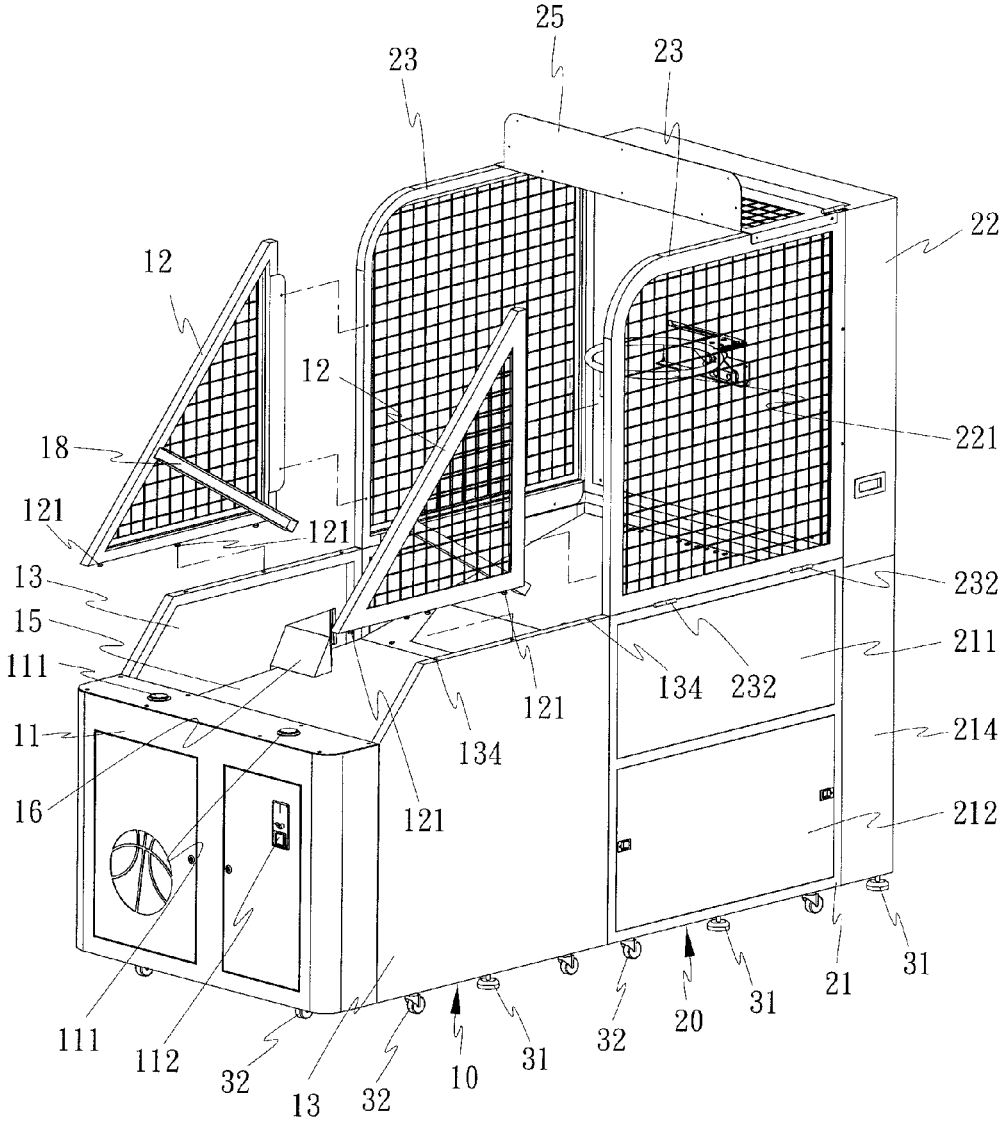
FIG. 3 corresponds to FIG. 2, showing the two upper side panels detached from the front cabinet unit after removal of the oblique baffle.
Figure 19:
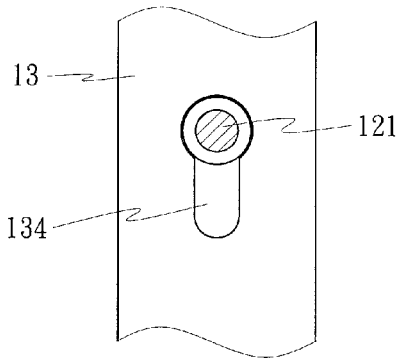
FIG. 19 is a schematic drawing showing the mounting rod of the upper side panel inserted into the associating mounting hole of the associating lower side panel according to the present invention.
Figure 20:
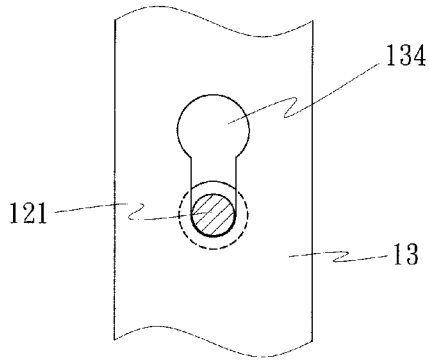
FIG. 20 corresponds to FIG. 19, showing the mounting rod forced into engagement with the mounting hole.

The two lower side panels 13 each have a plurality of mounting holes 134 at the top side. The upper side panels 12 each have a plurality of mounting rods 121 respectively disposed at the bottom side and respectively connectable to the mounting holes 134 of the lower side panels 13 (see FIG. 3). The mounting holes 134 are shaped like a keyhole so that the mounting rods 121 can be quickly inserted into the mounting holes 134 (see FIG. 19) and then moved to a distance into the engagement position (see FIG. 20). This coupling structure is simple an example; any of a variety of other known coupling structures may be used as a substitute.

Figure 2:
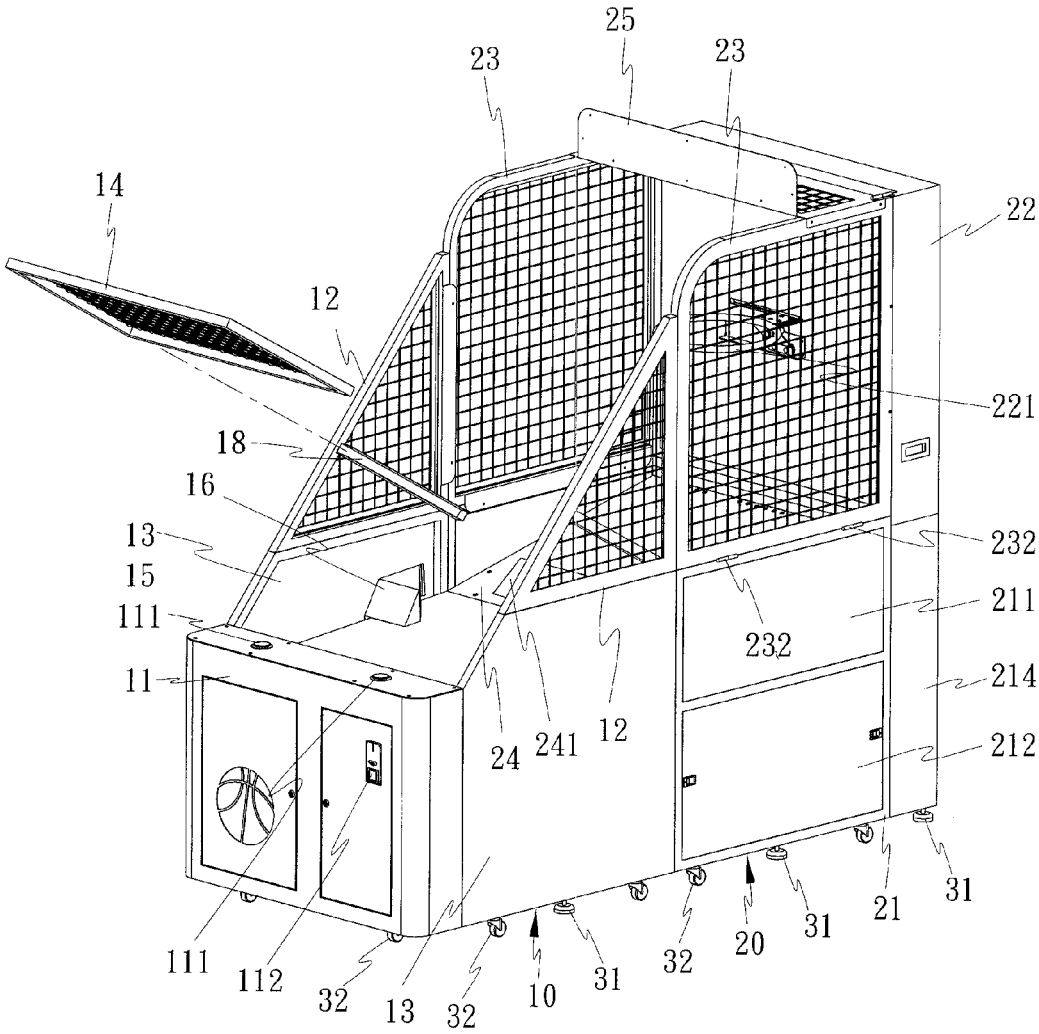
FIG. 2 corresponds to FIG. 1, showing the oblique baffle detached from the front cabinet unit.

Further, the upper side panels 12 each have an oblique track 18 at an inner side for receiving the oblique baffle 14 (see FIG. 2) so that the oblique baffle 14 can be quickly detachably installed in the front cabinet unit 10. The oblique baffle 14 is adapted to stop bounced basketballs from jumping out of the rear cabinet unit 20 and to guide it to the inner guide boards 24 and then to the outer guide board 15.

Figure 4:
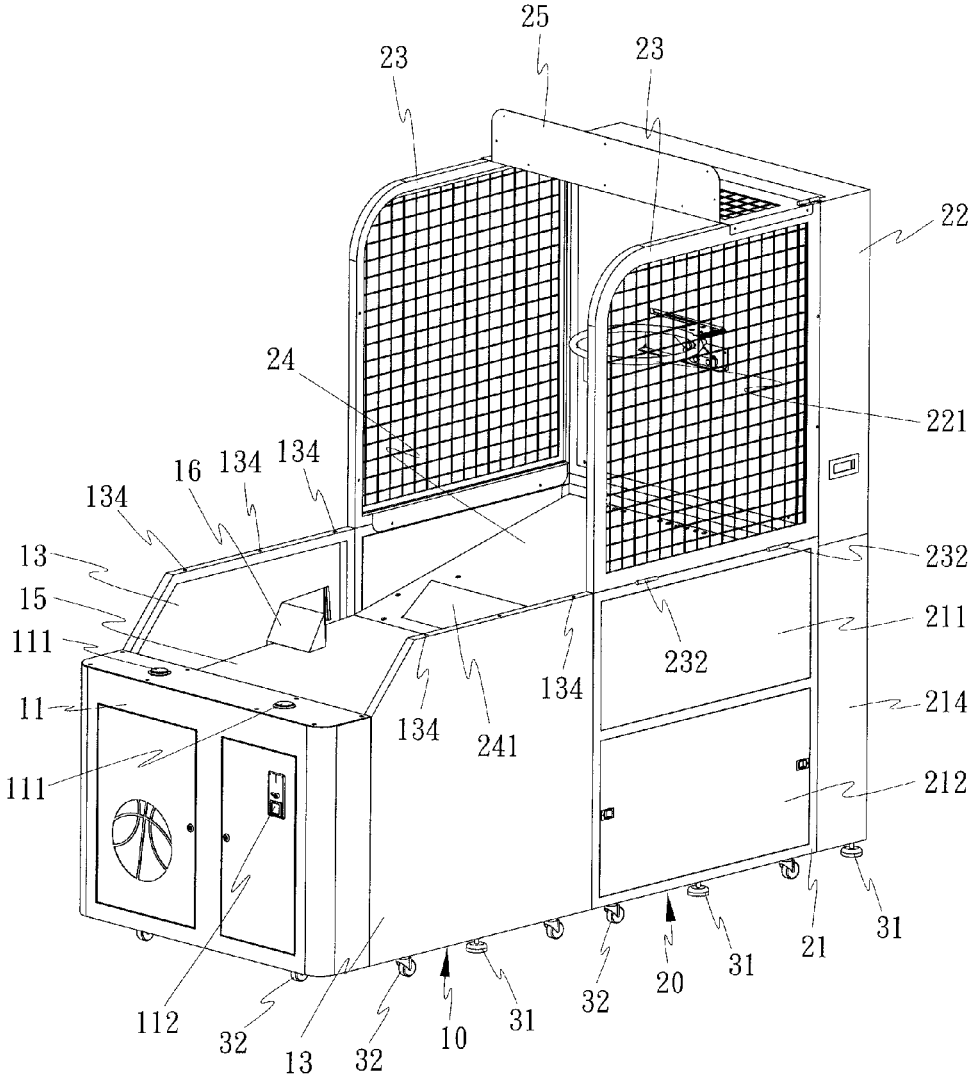
FIG. 4 corresponds to FIG. 3, showing the status of the basketball machine after removal of the oblique baffle and the upper side panels.

Further, a gate 241 is vertically movably mounted in the inner guide board 24 for stopping basketballs on the inner guide board 24 (see FIG. 4). When the player inserts the coin, the gate 241 is lowered to the received position below the elevation of the top surface of the inner guide board 24, allowing basketballs to move away from the inner guide board 24 to the front cabinet unit 10 to be replayed in the basketball shooting game. When the game is over, the gate 241 will be lifted to the extended position above the elevation of the top surface of the inner guide board 24. The lifting mechanism that moves the gate 241 is of the known art, no further detailed description in this regard is necessary.

Further, the aforesaid top plate 25 forms a bridge over the side panels 23 of the rear cabinet unit 20.

Figure 21:
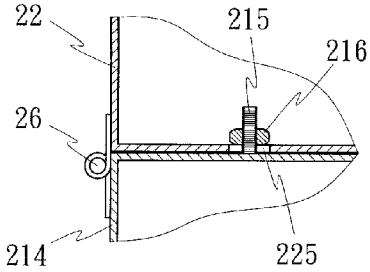
FIG. 21 is a schematic drawing showing the upright screw rod of the side jamb inserted into the associating bottom through hole of the vertical back rack and a lock nut fastened to the upright screw rod.
Figure 22:
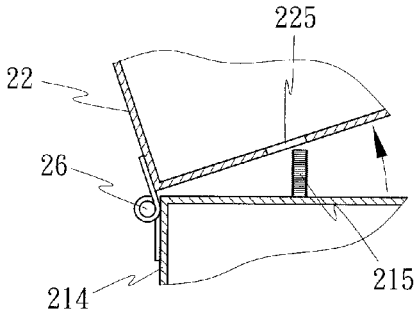
FIG. 22 corresponds to FIG. 21, showing the vertical back rack turned relative to the bottom box after removal of the lock nut from each upright screw rod.

Referring to FIGS. 21 and 22, the vertical back rack 22 has its bottom side hinged to the top side of the bottom box 21 by hinges 26. The two side jambs 214 of the bottom box 21 each have an upright screw 215 at the top. When the vertical back rack 22 is attached to the side jambs 214 at the top, the upright screws 215 are respectively inserted into a respective through hole 225 on the bottom side of the vertical back rack 22, and respective lock nuts 216 are respectively fastened to the upright screws 215 to lock the vertical back rack 22 and the side jambs 214.

Figure 14:
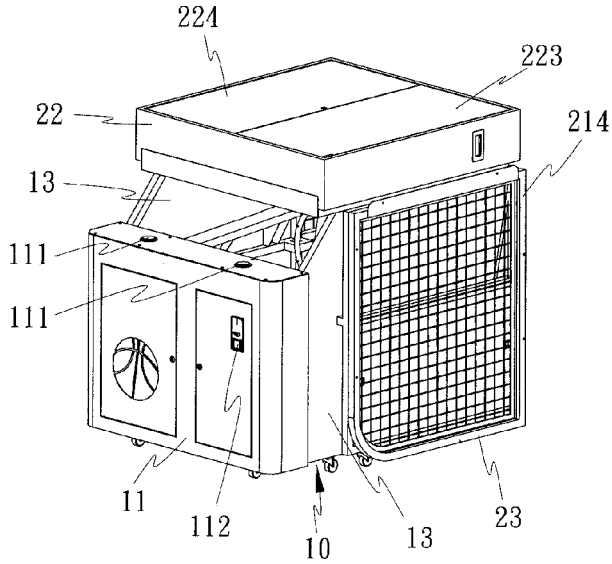
FIG. 14 corresponds to FIG. 13, showing the two lower side panels inserted into the bottom box of the collapsed rear cabinet unit.

When detaching the basketball machine (see FIG. 1), remove the oblique baffle 14 and the two upper side panels 12 (see FIGS. 2~4), then remove the outer guide board 15 and the stop blocks 16 (see FIG. 5), then separate the front cabinet unit 10 and the rear cabinet unit 20 (see FIG. 6), then remove the crosspiece 17, then remove the two upper sideboards 211 of the bottom box 21 (see FIG. 7), then lower the inner guide board 24 and remove the top plate 25 (see FIG. 8) to turn the two side panels 23 outwardly downwards so that they are closely attached to the two opposite lateral sides of the bottom box 21 (see FIG. 9), then open the door panels 223 and 224 of the vertical back rack 22 (see FIG. 10), then remove the lock nuts 216 from the upright screws 215, then turn the vertical back rack 22 forwardly downwards so that the vertical back rack 22 is closely attached to the top side of the bottom box 21 (see FIGS. 11 and 12), then adjust the positions of the lower side panels 13 to reduce the pitch between the lower side panels 13 (see FIG. 13), and then insert the lower side panels 13 into the collapsed rear cabinet unit 20 (see FIG. 14). When collapsed, the dimensions of the collapsed basketball machine are about one fourth of its original dimensions. Therefore, the invention saves much warehouse and transportation space during storage or delivery. Further, the front cabinet unit 10 and the rear cabinet unit 20 are equipped with wheels 32 and elevation-adjustable foot members 31. The wheels 32 allow the basketball machine to move easily. When the elevation-adjustable foot members 31 are extended out, they support the basketball machine stably on the floor, keeping the wheels 32 suspended above the floor.

A prototype of the quick detachable basketball machine has been constructed with the features of FIGS. 1~22. The quick detachable basketball machine functions smoothly to provide all of the features discussed earlier.

Although particular embodiments of the inventions have been described in detail for purposes of illustration, various modifications and enhancements may be made without departing from the spirit and scope of the invention. Accordingly, the invention is not to be limited except as by the appended claims.

What is claimed is:

1. A quick detachable basketball machine comprising a front cabinet unit and a rear cabinet unit, wherein:

said front cabinet unit comprises an electronic coin slot box, two lower side panels bilaterally detachably connected to a back wall of said electronic coin slot box, two upper side panels respectively detachably connected to a respective top side of said lower side panels, an oblique baffle obliquely detachably coupled between said two upper side panels, an outer guide board detachably supported between said lower side panels, and two stop blocks bilaterally mounted on said outer guide board; and said rear cabinet unit comprises a bottom box, said bottom box having a top wall and a back wall, a vertical back rack coupled to a rear side of the top wall of said bottom box and movable relative to said bottom box between a vertical position and a horizontal position where said vertical back rack is closely attached to the top wall of said bottom box, said vertical back rack holding a rim hoop ring at a front side thereof, and two side panels respectively hinged to two opposite lateral sides of the top wall of said bottom box and turnable relative to said bottom box between an operative position and a non-operative position where said two side panels are respectively closely attached to two opposite lateral sides of said bottom box.

2. The quick detachable basketball machine as claimed in claim 1, wherein said two lower side panels of said front cabinet unit each have an oblique rail for supporting said outer guide board.

3. The quick detachable basketball machine as claimed in claim 1, wherein said outer guide board has two side notches at two opposite sides for positioning said stop blocks.

4. The quick detachable basketball machine as claimed in claim 1, wherein said front cabinet unit further comprises a crosspiece detachably connected between said two lower side panels, said lower side panels each having a mounting hole for receiving said crosspiece.

5. The quick detachable basketball machine as claimed in claim 1, wherein said rear cabinet unit further comprises a top plate for bridging the side panels of said rear cabinet unit.

6. The quick detachable basketball machine as claimed in claim 1, wherein said rear cabinet unit comprises a motor-driven lifting means adapted to move said rim hoop ring vertically relative to said vertical back rack.

7. The quick detachable basketball machine as claimed in claim 1, wherein said vertical back rack has a back door means.

8. The quick detachable basketball machine as claimed in claim 1, wherein said lower side panels are detachably connected to the back wall of said electronic coin slot box in such a manner that the pitch between said lower side panels is adjustable.

9. The quick detachable basketball machine as claimed in claim 1, wherein said electronic coin slot box has a plurality of female coupling portions bilaterally symmetrically disposed at the back wall at different elevations, said female coupling portions each comprising a plurality of horizontally spaced coupling holes; said lower side panels of said front cabinet unit each have a plurality of male coupling portions selectively connectable to the coupling holes of the female coupling portions of said electronic coin slot box.

10. The quick detachable basketball machine as claimed in claim 1, wherein the upper side panels of said front cabinet unit each have a plurality of bottom mounting holes; the lower side panels of said front cabinet unit each have a plurality of top mounting rods respectively inserted into the bottom mounting holes of the upper side panels of said front cabinet unit.

11. The quick detachable basketball machine as claimed in claim 1, wherein the upper side panels of said front cabinet unit each have an oblique track at an inner side for supporting said oblique baffle.

12. The quick detachable basketball machine as claimed in claim 1, wherein said rear cabinet unit further comprises an inner guide board detachably supported between the two side panels, said inner guide board being hinged to said bottom box and turnable downwards, and a gate transversely mounted in said inner guide board and vertically movable between a first position below the elevation of said rear guide board and a second position above the elevation of said rear guide board.

13. The quick detachable basketball machine as claimed in claim 1, wherein said rear cabinet unit further comprises hinge means coupled between said vertical back rack and said bottom box.

14. The quick detachable basketball machine as claimed in claim 1, wherein said vertical back rack has two bottom through holes; said bottom box has two side jambs bilaterally hinged to the back wall thereof for supporting said vertical back rack, said side jambs each having a top upright screw respectively inserted into the bottom through holes of said vertical back rack and locked thereto with a respective lock nut.

15. The quick detachable basketball machine as claimed in claim 1, wherein said front cabinet unit and said rear cabinet unit are respectively equipped with a plurality of wheels and elevation-adjustable foot members.

* * * * *